US009650697B2

(12) United States Patent
Reigner et al.

(10) Patent No.: US 9,650,697 B2
(45) Date of Patent: May 16, 2017

(54) GRAY GOLD ALLOY FREE OF NICKEL AND COPPER

(75) Inventors: Michèle Reigner, Morges (CH); Jean-François Ricard, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 912 days.

(21) Appl. No.: 13/265,655

(22) PCT Filed: Apr. 15, 2010

(86) PCT No.: PCT/CH2010/000101

§ 371 (c)(1),
(2), (4) Date: Jan. 6, 2012

(87) PCT Pub. No.: WO2010/127458

PCT Pub. Date: Nov. 11, 2010

(65) Prior Publication Data

US 2012/0114522 A1 May 10, 2012

(30) Foreign Application Priority Data

May 6, 2009 (EP) ..... 09405077

(51) Int. Cl.
*C22C 5/02* (2006.01)
*C22F 1/14* (2006.01)

(52) U.S. Cl.
CPC . *C22C 5/02* (2013.01); *C22F 1/14* (2013.01)

(58) Field of Classification Search
CPC ..... C22C 5/02; C22F 1/14
See application file for complete search history.

(56) References Cited

U.S. PATENT DOCUMENTS

| | | | | | |
|---|---|---|---|---|---|
| 3,716,356 | A | * | 2/1973 | Burnett | C22C 5/02 420/508 |
| 6,156,266 | A | | 12/2000 | Cascone | |
| 6,342,182 | B1 | | 1/2002 | Vincent | |

FOREIGN PATENT DOCUMENTS

| | | | | | |
|---|---|---|---|---|---|
| CH | 684616 | A3 | | 11/1994 | |
| DE | 2136373 | A1 | | 11/1972 | |
| DE | 2136373 | A1 | * | 10/1983 | C22C 5/04 |
| DE | 3211703 | A1 | | 10/1983 | |
| DE | 3711207 | A1 | | 10/1988 | |
| DE | 19525361 | A1 | | 8/1996 | |
| EP | 1010768 | A1 | | 6/2000 | |
| EP | 1227166 | A1 | | 7/2002 | |
| JP | 04074836 | A | * | 3/1992 | C22C 5/02 |
| JP | 8-003662 | A | | 1/1996 | |
| JP | 8-003663 | A | | 1/1996 | |
| JP | 2000-336439 | A | | 12/2000 | |
| JP | 2001-207226 | A | | 7/2001 | |
| JP | 3139334 | U | | 3/2007 | |

OTHER PUBLICATIONS

English Machine Translation of DE 2136373 A1 of Knosp (Oct. 1983).*

International Search Report of PCT/CH2010/000101, mailing date Aug. 24, 2010.

* cited by examiner

*Primary Examiner* — Roy King

*Assistant Examiner* — Jophy S Koshy

(74) *Attorney, Agent, or Firm* — Westerman, Hattori, Daniels & Adrian, LLP

(57) ABSTRACT

The present invention relates to a gray gold alloy free of nickel and copper having a hardness that is suitable in particular for watchmakers and jewellers. Said alloy consists of (in wt %): more than 75% of Au; more than 18% to less than 24% of Pd; more than 1% to less than 6% of at least one element selected from among Mn, Hf, Nb, Pt, Ta, V, Zn and Zr; optionally, no more than 0.5% of at least one element selected from among Si, Ga and Ti; and optionally, no more than 0.2% of at least one element selected from among Ru, Ir and Re. The invention also relates to a method for preparing said alloy.

19 Claims, No Drawings

GRAY GOLD ALLOY FREE OF NICKEL AND COPPER

The present invention relates to a nickel-free and copper-free gray gold alloy having a hardness suitable in particular for watch and clock makers and jewelers. The invention also relates to a process for preparing this alloy.

BACKGROUND OF THE INVENTION

There are two main types of gray gold alloys on the market, nickel alloys and palladium alloys, in which these two elements act as whiteners.

Nickel, with its allergic potential, tends to be abandoned. Moreover, its alloys exhibit reduced hardness and reduced deformability which lend themselves poorly to the jewelry and watch and clock making fields.

Very many propositions have therefore been put forward in order to replace nickel.

Thus, patent applications EP 1 227 166 (AuCuMn alloy), EP 1 010 768 (AuCuPd alloy) and JP 3130334 (AuPdAgCu alloy) propose alloys that contain copper.

The addition of copper makes it possible to harden the alloys but it exhibits drawbacks, in particular an excessively low cooling rate (during ingot casting), and, during heat treatment, an uncontrollable hardening and a risk of cracking.

Furthermore, the increase in the copper concentration is achieved at the expense of other elements having whitening effects.

Moreover, copper has a risk of oxidation.

The Japanese patent application published under the number JP-A-H08-003662 describes white gold alloys belonging to the Au—Pd—In, Au—Pd—Sn or Au—Pd—Bi types. These alloys are intended for preparing metal clays, that is to say clays of precious metals. Indeed, metal clays are generally defined as being a raw material intended for the manufacture of jewels or of works of art and that comprise a very fine powder of precious metals, an organic binder and water. After the shaping thereof, they are dried and burnt so as to remove the organic binder, so that only the sintered metals remain. The subject of this Japanese patent application is therefore a powder of white gold alloy of the Au—Pd—In, Au—Pd—Sn or Au—Pd—Bi type that must exhibit excellent sinterability. In concrete terms, by mixing this powder with water, a binder (plasticizer: di-n-butyl phthalate) and a surfactant (ethyl cellulose), a metal clay having a high degree of sintering should be obtained.

However, as regards palladium, its alloys without addition of copper are too soft considering the substantial proportion that it is necessary to introduce in order to whiten the gold.

Furthermore, when choosing an alloy, other important parameters are the color and the brightness of the metal. Most of the alloys containing Pd and/or Cu require an electrodeposit of rhodium in order to come close to the intended color. The thickness of this coating (a few microns) remains sensitive to rubbing and the color of the substrate reappears randomly, which does not make it possible to produce articles made of gold that are intended to last.

In order not to require rhodium plating, a gold alloy must guarantee, according to the ASTM Method D1925 standard, a YI value: D1925<19 (YI: yellowness index), which is considered to be "good white" or "premium" and comes under the Grade 1 category (see also http://www.utilisegold-.com/jewellery technology/colours/white guide and Proceedings of Santa Fe Symposium 2005, pp. 103-120).

The YI value may be transposed in the CIELab system, CIE being the abbreviation of the Commission Internationale de l'Eclairage (International Commission on Illumination) and Lab being the three axes of coordinates, the L axis measuring the white-black component (black=0 and white=100), the a axis measuring the red-green component (red=positive values, green=negative values) and the b axis measuring the yellow-blue component (yellow=positive values, blue=negative values). (Cf. ISO 7724 standard established by the Commission Internationale de l'Eclairage) (International Commission on Illumination).

The colors of gold alloys are defined in the trichromatic space according to the ISO 8654 standard. A YI value <19 corresponds as a first approximation to [$-2 \leq a \leq 2$; $b \leq 10$].

BRIEF DESCRIPTION OF THE INVENTION

The objective of the present invention is to propose a nickel-free and copper-free gray gold alloy having satisfactory mechanical properties and also high whiteness (of Grade 1) while not requiring rhodium plating.

This objective is achieved by an alloy constituted of (in percentages by weight):

- more than 75% of Au;
- from more than 18% to less than 24% of Pd;
- from more than 1% to less than 6% of at least one element chosen from Mn, Hf, Nb, Pt, Ta, V, Zn and Zr;
- optionally, at most 0.5% of at least one element chosen from Si, Ga and Ti; and
- optionally, at most 0.2% of at least one element chosen from Ru, Ir and Re;
- the sum of all these percentages of course being equal to 100%.

Specifically, lengthy and intense research carried out by the inventors have enabled them to discover that such an alloy corresponds to all of the criteria required for alloys intended for jewelry and watch and clock making in particular, both from the point of view of the brightness and color and that of the corrosion resistance and ability to be worked and polished, while offering a hardness comparable to or greater than gray golds containing copper.

The gray gold alloy according to the invention may be prepared according to a process in which:

- the components of the gray gold alloy are placed in a crucible;
- the crucible is heated until the components melt;
- the molten alloy is cast;
- it is left to solidify;
- it is subjected to water hardening;
- it is subjected to at least one cold-rolling operation; and
- it is annealed in a reducing atmosphere.

DETAILED DESCRIPTION OF THE INVENTION

The general composition of the gray gold alloy according to the invention is indicated above.

The preferred composition of the gray gold alloy according to the invention is the following (expressed in percentages by weight):

- more than 75% of Au;
- from 19% to 23.5% of Pd;
- from 1.4% to 5.9% of at least one element chosen from Mn, Hf, Nb, Pt, Ta, V, Zn and Zr;
- optionally, at most 0.5% of at least one element chosen from Si, Ga and Ti; and optionally, at most 0.1% of at least one element chosen from Ru, Ir and Re.

Other characteristics of the gray gold alloy according to the invention, which are advantageous individually or in combination, are set out as follows:

the alloy comprises at least 20% of Pd;

it comprises at least 1.5% of Zr or of Nb;

it comprises from 0.002% to 0.006% (20 to 60 ppm) of Re;

it comprises around 75.1% of Au.

The elements such as Si and Ti are known to a person skilled in the art for improving, when they are added in small amounts, the surface appearance and the brightness and for reducing the risks of corrosion, without substantially modifying the hardness nor adversely affecting the color.

The elements such as Ir, Re or Ru are known for improving the metallurgical properties, in particular for guaranteeing the fineness of the grain and for preventing porosities, without substantially modifying the hardness nor adversely affecting the color.

Irrespective of its formulation, the alloy according to the invention always meets the following conditions:

$-2 \leq a \leq 2$ $b \leq 10$ and

HV annealed (Vickers hardness index after annealing) >85.

These properties are those that a gray gold alloy must possess in order to satisfy the requirements of watch and clock makers and jewelers.

Preparation of the Alloy According to the Invention

The alloys according to the invention are prepared under the following conditions:

the main elements incorporated into the composition of the alloy preferably have a purity of 99.95% except for the gold with 99.99% and Zr with 99.8%;

the alloy is obtained by melting the elements in a crucible (for example made of $ZrO_2$). The heating is obtained via induction in a leaktight furnace under a partial pressure (for example of argon at 800 mbar). The molten alloy is then cast in a graphite ingot mold. After solidification, the ingot mold is removed from the leaktight furnace and the ingot is removed from the mold, cooled by water hardening and optionally scalped;

the ingot is then cold-rolled one or more times until a degree of work hardening of 75 to 80% is obtained;

the annealing is carried out in a reducing atmosphere (preferably 80% $N_2$-20% $H_2$) for 30 minutes at 850° C.

EXAMPLES

In the examples which follow, table I groups together alloys made of 18 carat gray gold from the prior art that are commercially available.

Besides the composition of the alloys given in % by weight, this table gives indications relating to the Vickers hardness index HV of the alloy in the cast state (HV cast), work hardened to 75% (HV 75%) and annealed (HV annealed), and also the color measured in the CIELab system.

TABLE I (Prior art)

| | Commercial 18 carat gray gold (% by weight) | L | a | b | HV cast | HV 75% | HV annealed |
|---|---|---|---|---|---|---|---|
| 1 | Au 75 Ni 14.5 Cu 5.5 Zn 5 | 84.3 | −0.8 | 8.6 | — | 320 | 225 |
| 2 | Au 75 Pd 15 Cu 5 Ni 5 | 79.8 | 1.1 | 8.7 | — | 250 | 165 |
| 3 | Au 75 Pd 15 Cu 5 Mn 5 | 78.1 | 1.5 | 8.3 | — | 290 | 155 |
| 4 | Au 75 Ni 11 Cu 9.5 Zn 4.5 | 85.1 | 0.3 | 8.4 | 223 | 307 | — |
| 5 | Au 75 Pd 13 Cu 7.5 Ni 5 Zn 2 | 82.2 | 1.43 | 7.75 | — | — | — |
| 6 | Au 75 Pd 14.9 Cu 2.6 Ag 7.5 | 80 | 1.3 | 7.8 | 70 | 175 | 90 |
| 7 | Au 75 Cu 19.9 Mn 4.9(1) | 86.17 | 5.03 | 12.15 | 135 | 274 | 155 |
| 8 | Au 75 Pd 14 Cu 7.4 In 3.5(2) | 81 | 2.0 | 7.63 | 145 | 250 | 188 |
| 9 | Au 75.1 Pd 24.9 | 79.37 | 1.34 | 4.87 | 72 | 150 | 83 |

(1)according to EP 1 277 166

(2)according to EP 1 010 768

It is observed that the aforementioned conditions:

$-2 \leq a \leq 2$ $b \leq 10$ and

HV annealed >85 are still not cumulatively met.

Furthermore, alloy no. 6 has an HV value that is barely satisfactory, although it contains copper.

Alloy no. 9, which is composed only of gold and of palladium and is therefore free of copper, has a very low HV annealed value.

Table II below groups together gray gold alloys according to the invention which are ternary alloys.

TABLE II (Invention)

| | Ternary 18 carat golds (% by weight) | L | a | b | HV cast | HV 75% | HV annealed |
|---|---|---|---|---|---|---|---|
| 11 | Au 75.1 Pd 22.0 V 2.9 | 81.04 | 1.33 | 5.36 | 115 | 195 | 127 |
| 12 | Au 75.1 Pd 20.0 V 4.9 | 82.15 | 1.10 | 5.03 | 125 | 230 | 157 |
| 13 | Au 75.1 Pd 21.0 Ta 3.9 | 80.15 | 1.35 | 5.14 | 135 | 213 | 164 |
| 14 | Au 75.1 Pd 23.0 V 1.9 | 79.34 | 1.38 | 5.05 | 90 | 182 | 112 |
| 16 | Au 75.1 Pd 22.0 Zn 2.9 | 79.36 | 1.37 | 4.84 | 80 | 156 | 108 |
| 17 | Au 75.1 Pd 23.5 Zr 1.4 | 80.06 | 1.30 | 4.73 | 87 | 179 | 119 |
| 18 | Au 75.1 Pd 23.0 Zr 1.9 | 79.72 | 1.32 | 5.10 | 91 | 180 | 127 |
| 19 | Au 75.1 Pd 22.5 Zr 2.4 | 79.76 | 1.22 | 4.83 | 105 | 202 | 136 |
| 20 | Au 75.1 Pd 22.0 Zr 2.9 | 79.91 | 1.19 | 4.67 | 135 | 220 | 157 |
| 21 | Au 75.1 Pd 21.5 Zr 3.4 | 80.14 | 1.15 | 4.54 | 164 | 249 | 194 |
| 22 | Au 75.1 Pd 21.0 Zr 3.9 | — | — | — | 179 | — | — |
| 23 | Au 75.1 Pd 23.0 Mn 1.9 | 79.10 | 1.35 | 5.12 | 72 | 150 | 100 |
| 24 | Au 75.1 Pd 22.0 Mn 2.9 | 79.77 | 1.33 | 4.86 | 73 | 156 | 105 |
| 25 | Au 75.1 Pd 21.0 Mn 3.9 | 79.03 | 1.32 | 4.95 | 90 | 182 | 104 |
| 26 | Au 75.1 Pd 20.0 Mn 4.9 | 78.73 | 1.28 | 5.02 | 135 | 217 | 150 |
| 27 | Au 75.1 Pd 23.5 Nb 1.4 | 80.34 | 1.37 | 5.15 | 97 | 173 | 124 |
| 28 | Au 75.1 Pd 23.0 Nb 1.9 | 81.28 | 1.35 | 4.86 | 132 | 200 | 151 |
| 29 | Au 75.1 Pd 22.5 Nb 2.4 | 80.76 | 1.32 | 4.76 | 120 | 192 | 144 |
| 30 | Au 75.1 Pd 22.0 Nb 2.9 | 81.02 | 1.34 | 5.17 | 138 | 221 | 168 |
| 31 | Au 75.1 Pd 21.5 Nb 3.4 | 80.94 | 1.34 | 5.70 | 138 | 221 | 168 |
| 32 | Au 75.1 Pd 21.0 Nb 3.9 | 81.00 | 1.29 | 5.15 | 135 | 230 | 208 |

Each of the ternary alloys Nos. 11-14 and 16-32 according to the invention therefore has satisfactory L, a, b and HV annealed values.

Table III below relates to quaternary and quinternary alloys according to the invention.

TABLE III (Invention)

| | Quaternary and quinternary 18 carat golds (% by weight) | L | a | b | HV cast | HV 75% | HV annealed |
|---|---|---|---|---|---|---|---|
| 33 | Au 75.1 Pd 21.0 Nb 1.9 Zr 2.0 | 80.76 | 1.18 | 4.53 | 167 | 260 | 169 |
| 34 | Au 75.1 Pd 21.0 Nb 1.9 Mn 2.0 | 80.41 | 1.33 | 4.79 | 133 | 213 | 147 |
| 35 | Au 75.1 Pd 21.0 Zr 2.0 Mn 1.9 | 79.95 | 1.24 | 4.55 | 150 | 237 | 153 |
| 36 | Au 75.1 Pd 19.0 Nb 2.0 Zr 2.0 Mn 1.9 | 80.77 | 1.13 | 4.16 | 170 | 285 | 255 |
| 37 | Au 75.1 Pd 20.0 Zr 2.0 Pt 2.4 Ga 0.5 | 79.86 | 1.20 | 4.65 | 185 | 226 | 192 |
| 38 | Au 75.1 Pd 20.0 Zr 2.5 Pt 2.4 | 79.96 | 1.14 | 4.31 | 153 | 209 | 188 |

It is observed that the quaternary alloys according to the invention nos. 33 to 35 and 38 and quinternary alloys according to the invention nos. 36 and 37 all have satisfactory L, a, b and HV annealed values.

Reported in table IV below are the effects of the grain refiners commonly used in 18 carat gray golds on an alloy according to the invention composed of 75.3 Au, 21.7 Pd and 3.0 Zr (in % by weight).

It is observed that the L, a and b values of such an alloy are not adversely affected by the addition of grain refiners.

The grain index is established according to the ASTM E 112 standard.

TABLE IV (Invention)

| | Grain refiner | Concentration (ppm) | Grain index (ASTM E 112) |
|---|---|---|---|
| 39 | Iridium | 500 | 2 |
| 40 | Iridium | 1000 | 3 |
| 41 | Ruthenium | 500 | 4 |
| 42 | Ruthenium | 1000 | 7 |
| 43 | Rhenium | 20 | 5 |
| 44 | Rhenium | 50 | 6 |

Moreover, all the alloys from table IV have a satisfactory hardness after annealing.

Furthermore, alloys 39 and 40 display a columnar grain structure, the columns of which are oriented in the direction of solidification. The other alloys exhibit an equiaxed microstructure. Ruthenium has the most pronounced grain refining effect, however numerous inclusions are observed which may have a detrimental effect on the polishing. Rhenium displays a grain refining ability without formation of inclusions. The addition of rhenium at a level of 20 to 60 ppm consequently gives an excellent polishability.

The invention claimed is:

1. A nickel-free and copper-free gray gold alloy, consisting of, in percentage by weight:

more than 75% of Au;

from more than 18% to 23.5% of Pd;

from at least 1.4% to at most 5.9% from at least one element chosen from a third group consisting of Mn, Hf, Nb, Ta, and Zr;

either (i) 0% of all elements from a first group consisting of Si, Ga and Ti, or (ii) at least one element chosen from the first group, wherein a total percentage of the element(s) from the first group is from more than 0% to at most 0.5%;

either (i) 0% of all elements from a second group consisting of Ru, Ir and Re, or (ii) at least one element chosen from the second group, wherein a total percentage of the element(s) from the second group is from more than 0% to at most 0.2%; and wherein the alloy is suitable for making watches, clocks and jewelry, and has (i) a color that has, in the CIELAB trichromatic space, a value of −2 to 2 on the red-green axis, a value of at most 10 on the yellow-blue axis, and a value of at least 78 on the white-black axis, and (ii) a Vickers hardness index value after annealing greater than 85.

2. The gray gold alloy as claimed in claim 1, wherein the percentage of Pd is from 19% to 23.5% by weight; and wherein either (i) the total percentage of all elements from the second group is 0% by weight, or (ii) the total percentage of the element(s) from the second group is from more than 0% to at most 0.1% by weight.

3. The gray gold alloy as claimed in claim 1, wherein the percentage of Pd is from 20% to 23.5% by weight.

4. The gray gold alloy as claimed in claim 1, wherein the percentage of Zr or of Nb is from 1.5% to 5.9% by weight.

5. The gray gold alloy as claimed in claim 1, wherein the percentage of Re is from 0.002% to 0.006% by weight.

6. The gray gold alloy as claimed in claim 1, wherein the percentage of Au is 75.1% by weight.

7. The gray gold alloy as claimed in claim 1, wherein the alloy has a yellowness index of less than 19 according to the ASTM Method D1925 standard.

8. The gray gold alloy as claimed in claim 2, wherein the percentage of Pd is from 20% to 23.5% by weight.

9. The gray gold alloy as claimed in claim 2, wherein the percentage of Zr or of Nb is from 1.5% to 5.9% by weight.

10. The gray gold alloy as claimed in claim 2, wherein the percentage of Re is from 0.002% to 0.006% by weight.

11. The gray gold alloy as claimed in claim 3, wherein the percentage of Zr or of Nb is from 1.5% to 4.9% by weight.

12. The gray gold alloy as claimed in claim 3, wherein the percentage of Re is from 0.002% to 0.006% by weight.

13. The gray gold alloy as claimed in claim 4, wherein the percentage of Re is from 0.002% to 0.006% by weight.

14. A process for preparing the gray gold alloy of claim 1, comprising:

placing components of the gray gold alloy in a crucible;

heating the crucible until the components melt to form a molten alloy;

casting the molten alloy to form a cast alloy;

leaving the cast alloy to solidify to form a solidified alloy;

subjecting the solidified alloy to water hardening to form a hardened alloy;

subjecting the hardened alloy to at least one cold-rolling operation to form a cold-rolled alloy; and annealing the cold-rolled alloy in a reducing atmosphere, so as to obtain the gray gold alloy.

15. The process as claimed in claim 14, in which the heating is carried out via induction in a leaktight furnace under a partial pressure of an inert gas.

16. The process as claimed in claim 15, in which the inert gas is Ar.

17. The process as claimed in claim 14, in which the annealing is carried out in a reducing atmosphere constituted of a mixture of $N_2$ and $H_2$.

18. The process as claimed in claim 14, in which the annealing is carried out over around 30 minutes.

19. The process as claimed in claim 14, in which the annealing is carried out at around 850° C.

* * * * *